US007447639B2

(12) United States Patent
Wang

(10) Patent No.: US 7,447,639 B2
(45) Date of Patent: Nov. 4, 2008

(54) SYSTEM AND METHOD FOR ERROR CONCEALMENT IN DIGITAL AUDIO TRANSMISSION

(75) Inventor: Ye Wang, Tampere (FI)

(73) Assignee: Nokia Corporation, Espoo (FI)

( * ) Notice: Subject to any disclaimer, the term of this patent is extended or adjusted under 35 U.S.C. 154(b) by 1146 days.

(21) Appl. No.: 10/020,579

(22) Filed: Dec. 14, 2001

(65) Prior Publication Data

US 2002/0138795 A1 Sep. 26, 2002

Related U.S. Application Data

(63) Continuation-in-part of application No. 09/770,113, filed on Jan. 24, 2001, and a continuation-in-part of application No. 09/966,482, filed on Sep. 28, 2001.

(51) Int. Cl.
*G10L 21/04* (2006.01)

(52) U.S. Cl. ..... 704/503; 704/230

(58) Field of Classification Search ..... 704/201, 704/219, 230, 500–504
See application file for complete search history.

(56) References Cited

U.S. PATENT DOCUMENTS 5,040,217 A 8/1991 Brandenburg et al.
5,148,487 A 9/1992 Nagai et al.
5,256,832 A 10/1993 Miyake
5,285,498 A 2/1994 Johnston
5,361,278 A * 11/1994 Vaupel et al. ..... 375/240
5,394,473 A * 2/1995 Davidson ..... 704/200.1
5,481,614 A 1/1996 Johnston
5,579,430 A 11/1996 Grill et al.
5,636,276 A 6/1997 Brugger
5,841,979 A 11/1998 Schulhof et al.
5,852,805 A * 12/1998 Hiratsuka et al. ..... 704/500
5,875,257 A 2/1999 Marrin et al.
5,886,276 A * 3/1999 Levine et al. ..... 84/603
5,928,330 A 7/1999 Goetz et al.
6,005,658 A 12/1999 Kaluza et al.

(Continued)

FOREIGN PATENT DOCUMENTS

DE 197 36 669 10/1998

(Continued)

OTHER PUBLICATIONS

Malvar, "Biorthogonal and Nonuniform Lapped Transforms for Transform Coding with Reduced Blocking and Ringing Artifacts", IEEE Transactions on Signal Processing, col. 46, Issue 4, Apr. 1998, pp. 1043-1053.*

(Continued)

*Primary Examiner*—Michael N Opsasnick
(74) *Attorney, Agent, or Firm*—Banner & Witcoff, Ltd.

(57) ABSTRACT

A beat-pattern based error concealment system and method which detects drum-like beat patterns of music signals on the encoder side of the system and embeds the beat information as data ancillary to a preceding audio data interval in the transmitted compressed bitstream. The embedded information is then used to perform an error concealment task on the decoder side of the system. The beat detector functions as part of an error concealment system in an audio decoding section used in audio information transfer and audio download-streaming system terminal devices such as mobile phones. The disclosed sender-based method improves error concealment performance while reducing decoder complexity.

39 Claims, 11 Drawing Sheets

U.S. PATENT DOCUMENTS

| | | | | |
|---|---|---|---|---|
| 6,064,954 | A | 5/2000 | Cohen et al. | |
| 6,115,689 | A * | 9/2000 | Malvar | 704/503 |
| 6,125,348 | A | 9/2000 | Levine | |
| 6,141,637 | A * | 10/2000 | Kondo | 704/204 |
| 6,175,632 | B1 | 1/2001 | Marx | |
| 6,199,039 | B1 | 3/2001 | Chen et al. | |
| 6,287,258 | B1 | 9/2001 | Phillips | |
| 6,305,943 | B1 | 10/2001 | Pougatchev et al. | |
| 6,453,282 | B1 | 9/2002 | Hilpert et al. | |
| 6,477,150 | B1 * | 11/2002 | Maggenti et al. | 370/312 |
| 6,597,961 | B1 * | 7/2003 | Cooke | 700/94 |
| 6,738,524 | B2 | 5/2004 | De Queiroz | |
| 6,766,300 | B1 * | 7/2004 | Laroche | 704/500 |
| 6,787,689 | B1 | 9/2004 | Chen | |
| 6,807,526 | B2 | 10/2004 | Touimi et al. | |

FOREIGN PATENT DOCUMENTS

| | | |
|---|---|---|
| EP | 0 703 712 A2 | 3/1996 |
| EP | 0 718 982 A2 | 6/1996 |
| EP | 1 207 519 | 5/2002 |
| WO | WO 93/26099 | 6/1993 |
| WO | 98/13965 | 4/1998 |

OTHER PUBLICATIONS

Goto Masataka, et al., "Beat Tracking based on Multiple-agent Architecture-A Real-time Beat Tracking System for Audio Signals," pp. 103-110, 1996.
Scheirer, Eric D., "Tempo and Beat Analysis of Acoustic Music Signals", J. Acoust. Soc. Am. 103 (1), Jan. 1998, pp. 588-601.
Herre, J. et al., Extending the MPEG-4AAC Codec by Perceptual Noise Substitution, 104th AES Convention, Amsterdam 1998, preprint 4720.
UMTS (Universal Mobile Telecommunications System), <http://www.pcwebopedia.com/TERM/U/UMTS.html>, Dec. 13, 2001.
WLAN (Wireless Local Area Network), <http://www.pcwebopedia.com/TERM/W/WLAN.html>, Dec. 13, 2001.
WDDMA (Wideband CDMA), <http://www.pcwebopedia.com/TERM/W/WCDMA.html>, Dec. 13, 2001.
GPRS (General Packet Radio Service), <http://www.pcwebopedia.com/TERM/G/GPRS.html>, Dec. 13, 2001.
GSM (Global System for Mobile Communications), <http://www.pcwebopedia.com/TERM/G/GSM.html>, Dec. 13, 2001.
Davis Pan, "A Tutorial on MPEG/Audio Compression," IEEE Multimedia, pp. 60-74, (Summer 1995).
A Free Audio Compression Format? http://www.sulaco.org/mp3/free.html>.Sep. 24, 2001.
Yajnik, M. et al., "Packet Loss Correlation in the Mbone Multicast Network", Proc. IEEE Global Internet Conference, Nov. 1996.
Jayant, N.S., et al., "Effects of Packet Losses in Waveform Coded Speech and Improvements due to an Odd-Even Sample Interpolation Procedure", IEEE Trans. Commun., vol. COM-29, No. 2, Feb. 1981, pp. 101-109.
Carle, G., et al., "Survey of Error Recovery Techniques for IP-Based Audio-Visual Multicast Applications", IEEE Network, Nov./Dec. 1997.
Wang, Y. et al., "A Compressed Domain Beat Detector Using MP3 Audio Bitstream", The 9th ACM International Multimedia Conference (ACM Multimedia 2001), Sep. 30-Oct. 5, 2001, Ottawa, Ontario, Canada pp. 194-202.
Search Report.
Y. Wang et al., "On The Relationship Between MDCT, SDFT And DFT", WCC 2000—ISCP 2000, Aug. 21-25, 2000, pp. 44-47.
Y. Wang et al., "A Compressed Domain Beat Detector Using MP3 Audio Bitstreams", Proceedings Of The ACM International Multimedia Conference And Exhibition 2001, ACM Multimedia 2001 Workshops, Sep. 30, 2001, pp. 194-202.
Y. Wang, "A Beat-Pattern based Error Concealment Scheme for Music Delivery with Burst Packet Loss", 2001 IEEE International Conference on Multimedia and Expo, ICME 2001, Aug. 22-25, 2001, pp. 73-76.
Wasem, O.J. et al, "The Effects of Waveform Substitution on the Quality of PCM Packet Communications," IEEE Trans. Acoustics, Speech, and Sig. Processing, vol. 36 No. 3, Mar. 1988, pp. 342-348.
Sanneck, H. et al., "A New Technique for Audio Packet Loss Concealment," IEEE Global Internet 1996, Dec. 1996 pp. 48-52.
Chen, Y.L., Chen, B.S., "Model-based Multirate Representation of Speech Signals and its Application to Recovery of Missing Speech Packets," IEEE Trans. Speech and Audio Processing, vol. 15, No. 3, May 1997, pp. 220-231.
A Free Audio Compression Format?, http://www.sulaco.org/mp3/free.html>, Sep. 24, 2001.
Herre, et al, Evaluation of Concealment Techniques for compressed Digital Audio, Audtio Engineering Society Preprint, Mar. 16-19, 1993, Preprint 3460 (A1-4), Erlangen, Germany.
Bolot et al, Analysis of Audio Packet Loss in the Internet, Proc. Of 5th Int. Workshop on Network and Operating System Support for Digital, Audio and Video, pp. 163-174, Durham, Apr. 1995.
International Standard ISO/IEC, Information Technology—Coding of Moving Pictures and Associated Audio for Digital Storage Media at up to About 1.5 Mbit/s—Part 3, Audio Technical Corrigendum 1, Published Apr. 15, 1996.
Stenger, et al, A New Error Concealment Technique for Audio Transmission with Packet Loss, Telecommunications Institute, University of Erlangen-Nuremberg, Cauerstrasse 7, 91058 Erlangen, Germany, Eusipco 1996.
McKinley et al, Experimental Evaluation of Forward Error Correction on Multicast Audio Streams in Wireless LANs, Department of Computer Science and Engineering, Michigan State University, East Lansing, Michigan 48824, pp. 1-10, Copyright 2000 ACM.
Nishihara et al, A Practical Query-By-Humming System for a Large Music Database, NTT Laboratores, 1-1 Hikarinooka, Yokosuka-shi, Kanagawa, 239-0847, Japan pp. 1-38, Dec. 2000.
Wang, Y., Vilermo, M., Isherwood, D. "The Impact of the Relationship Between MDCT and DFT on Audio Compression: A Step Towards Solvign the Mismatch", the First IEEE Pacific-Rim Conference on Multimedia (IEEE-PCM2000), Dec. 13-15, 2000, Sydney, Australia, pp. 130-138.
Perkins, C., Hodson, O., Hardman, V., "A Survey of Packet-loss Recovery Techniques for Streaming Audio," IEEE Network, Sep./Oct. 1998.
ETSI Rec. GSM 6.11, "Substitution and Muting of Lost Frames for Full Rate Speech Signals," 1992.
Goodman, O.J. et al., "Waveform Substitution Techniques for Recovering Missing Speech Segments in Packet Voice Communications," IEEE Trans. Acoustics, Speech, and Sig. Processing, vol. ASSP-34, No. 6, Dec. 1986, pp. 1440-1448.
Bosse, Modified Discrete Cosine Tranform (MDCT), Mar. 7, 1998, available at http://ccrma-www.standford.edu/~bosse/proj/node27.html.
Fraunhofer, MPEG Audio Layer-3, available at http://www.iis.fhg.de/amm/techinf/layer3/index.html, 1992.
WCDMAN—the wideband 'radio pipe' for 3G services, Sep. 17, 1999, available at http://www. ericsson.com/wireless/productsys/gsm/subpages/umts_and_3g/wcdman.shtml.
GSM Frequently Asked Questions, Oct. 23, 2000, available at http://www.gsmworld.com/technology/faw.html.
Perkins, Hodson, Options for Repair of Streaming Media, Network Working Group RFC 2354, The Internet Society, Jun. 1998.
Goto & Hayamizu, A Real-time Music Scene Description System: Detecting Melody and Bass Lines in Audio Signals, Aug. 1999, Working Notes of the IJCAI-99 Workshop on Computational Auditory Scence Analysis, p. 31-40.
Written Opinion for PCT/US02/01837 dated Mar. 28, 2008.

* cited by examiner

SYSTEM AND METHOD FOR ERROR CONCEALMENT IN DIGITAL AUDIO TRANSMISSION

CROSS-REFERENCE TO RELATED APPLICATION

This application is a continuation-in-part of commonly-assigned U.S. patent applications Ser. No. 09/770,113 entitled "System and Method for Concealment of Data Loss in Digital Audio Transmission" filed Jan. 24, 2001, and of Ser. No. 09/966,482 entitled "System and Method for Compressed Domain Beat Detection in Audio Bitstreams" filed Sep. 28, 2001.

FIELD OF THE INVENTION

This invention relates to the concealment of transmission errors occurring in digital audio streaming applications and, in particular, to a beat-detection error concealment process.

BACKGROUND OF THE INVENTION

The transmission of audio signals in compressed digital packet formats, such as MP3, has revolutionized the process of music distribution. Recent developments in this field have made possible the reception of streaming digital audio with handheld network communication devices, for example. However, with the increase in network traffic, there is often a loss of audio packets because of either congestion or excessive delay in the packet network, such as may occur in a best-effort based IP network.

Under severe conditions, for example, errors resulting from burst packet loss may occur which are beyond the capability of a conventional channel-coding correction method, particularly in wireless networks such as GSM, WCDMA or BLUETOOTH. Under such conditions, sound quality may be improved by the application of an error-concealment algorithm. Error concealment is an important process used to improve the quality of service (QoS) when a compressed audio bitstream is transmitted over an error-prone channel, such as found in mobile network communications and in digital audio broadcasts.

Perceptual audio codecs, such as MPEG-1 Layer III Audio Coding (MP3), as specified in the International Standard ISO/IEC 11172-3 entitled "Information technology of moving pictures and associated audio for digital storage media at up to about 1,5 Mbits/s—Part 3: Audio," and MPEG-2 Advanced Audio Coding (AAC), use frame-wise compression of audio signals, the resulting compressed bitstream then being transmitted over the audio packet network. With rapid deployment of audio compression technologies, more and more audio content is stored and transmitted in compressed formats.

A critical feature of an error concealment method is the detection of beats (i.e., short transient signals) so that replacement information can be provided for missing data. Beat detection or tracking is an important initial step in computer processing of music and is useful in various multimedia applications, such as automatic classification of music, content-based retrieval, and audio track analysis in video. Systems for beat detection or tracking can be classified according to the input data type, that is, systems for musical score information such as MIDI signals, and systems for real-time applications.

Beat detection, as used herein, refers to the detection of physical beats, that is, acoustic features or other signal transients exhibiting a higher level of energy, or peak, in comparison to the adjacent audio stream. Thus, a 'beat' would include a drum beat, but would not include a perceptual musical beat, perhaps recognizable by a human listener, but which produces little or no sound.

However, most conventional beat detection or tracking systems function in a pulse-code modulated (PCM) domain. They are computationally intensive and not suitable for use with compressed domain bitstreams such as an MP3 bitstream, which has gained popularity not only in the Internet world, but also in consumer products. A compressed domain application may, for example, perform a real-time task involving beat-pattern based error concealment for streaming music over error-prone channels having burst packet losses.

The wireless channel is another source of error that can also lead to packet loss. Under such conditions, sound quality may be improved by the application of an error-concealment algorithm. Error concealment is usually a receiver-based error recovery method, which serves as the last resort to mitigate the degradation of audio quality when data packets are lost in audio streaming over error prone channels such as mobile Internet.

As can be appreciated by one skilled in the relevant art, streaming uncompressed audio over wireless channel is simply an uneconomic use of the scarce resource, and a compressed audio bitstream is more sensitive to channel errors in comparison with an uncompressed bitstream (after removing most of the signal redundancy and irrelevance).

Conventional error concealment schemes employ small segment (typically around 20 msec) oriented concealment methods including: muting, packet repetition, interpolation, time-scale modification, and regeneration-based schemes. However, a fundamental limitation of packet repetition and other existing error concealment schemes is that they all operate with the assumption that the audio signals are short-term stationary. Thus, if the lost or distorted portion of the audio signal includes a short transient signal, such as a drum-beat, the conventional methods will not be able to produce satisfactory results.

What is needed is an audio data decoding and error concealment system and method operative in a compressed domain which provides high accuracy with a relatively less complex system at the receiver end.

SUMMARY OF THE INVENTION

The present invention discloses a beat-pattern based error concealment system and method which detects drum-like beat patterns of music signals on the encoder side of the system and embeds the beat information as data ancillary to a preceding audio data interval in the transmitted compressed bitstream. The embedded information is then used to perform an error concealment task on the decoder side of the system. The beat detector functions as part of an error concealment system in an audio decoding section used in audio information transfer and audio download-streaming system terminal devices such as mobile phones. The disclosed method results from the observation that, while the majority of packet losses in streaming applications are single packet losses, even these single packet losses can result in significant degradation in the subjective audio quality. The disclosed sender-based method improves error concealment performance while reducing decoder complexity.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
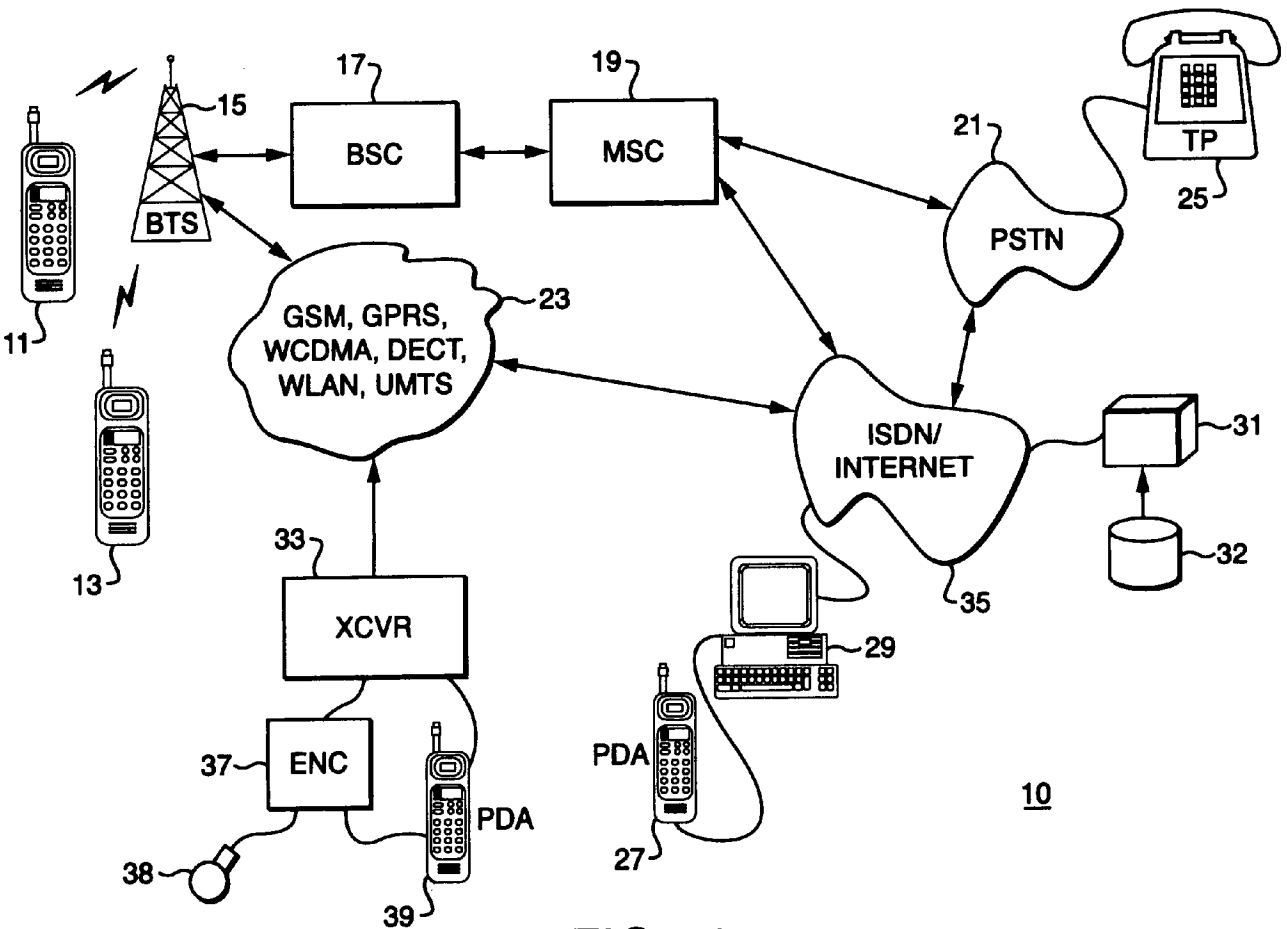
FIG. 1 (PRIOR ART)
FIG. 1 is a general block diagram of a conventional audio information transfer and streaming system including mobile telephone terminals.

FIG. 1 presents an audio information transfer and audio download and/or streaming system 10. System 10 comprises a receiving terminal, such as a mobile phone 11, a base transceiver station 15, a base station controller 17, a mobile switching center 19, a wired telecommunication network 21 such as accessible by a telephone 25, and a telecommunication network 35 accessible by a computer 29 or a user terminal such as a personal digital assistant 27 interconnected either directly or over the computer 29. In addition, there may be provided an audio source, such as a server unit 31 which includes a central processing unit, memory (not shown), and a database 32, as well as a connection to the telecommunication network 35, which may comprise the Internet, an ISDN network, or any other telecommunication network that is in connection either directly or indirectly to the network into which the mobile phone 11 is capable of being connected, either wirelessly or via a wired line connection. In a typical audio data transfer system, the mobile terminals and the server unit 31 are point-to-point connected.

Additionally, the telecommunications network 35 and the wired network 21 are interconnected with a wireless telecommunications network 23, which can be a Global System for Mobile Communications (GSM), a General Packet Radio Service (GPRS), Wideband CDMA (WCDMA), DECT, wireless LAN (WLAN), or a Universal Mobile Telecommunications System (UMTS), for example. An alternate audio source can be provided to the wireless telecommunications network 23 via a wireless transceiver 33. Audio signals picked up by a microphone 38 can be encoded by an encoder 37 and provided to the wireless transceiver 33. Alternatively, a source PDA 39 having an internal encoder can provide audio information to the wireless telecommunications network 23 directly through the wireless transceiver 33. Yet another alternative source of audio information is a source mobile phone 13 communicating either directly or indirectly with the base transceiver station 15.

The user of the mobile phone 11 may select audio data for downloading, such as a short interval of music or a short video with audio music. In a 'select request' from the user, the terminal address of the mobile phone 11 is known to the server unit 31 as well as the detailed information of the requested audio data (or multimedia data) in such detail that the requested information can be downloaded. The server unit 31 then downloads the requested information to another connection end. If connectionless protocols are used between the mobile phone 11 and the server unit 31, the requested information is transferred by using a connectionless connection in such a way that recipient identification of the mobile phone 11 is thereby connected with the transferred audio information.

Figure 2:
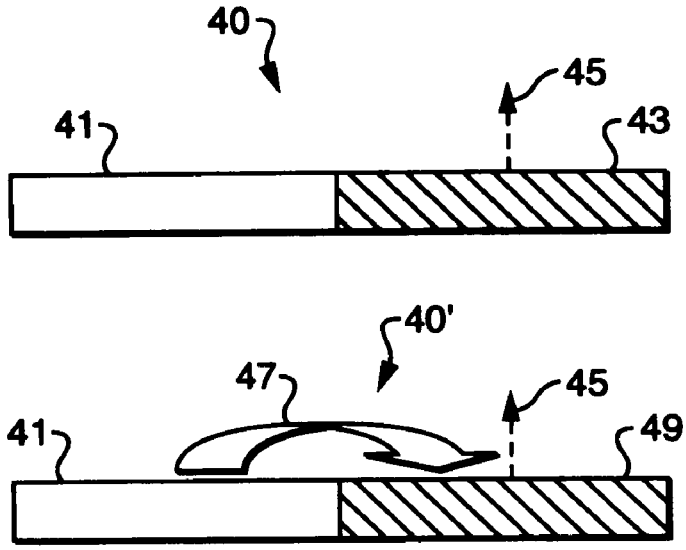
FIG. 2 (PRIOR ART)
FIG. 2 is an illustration of a missing transient signal resulting from conventional error-concealment.

A fundamental shortcoming in the operation of the system 10 can be explained with reference to FIG. 2 in which is shown an audio stream portion 40 such as may be sent to the mobile phone 11 from the server unit 31, from the wireless transceiver 33, or from the source mobile phone 13. The audio stream portion 40 includes an error-free audio data interval (ADI) 41 followed by a defective audio data interval 43. The defective audio data interval 43, which may comprise a corrupted or a missing audio data interval, originally included a short transient signal 45 (where the dashed arrow indicates that the transient signal 45 was corrupted or missing and not received). In a conventional method of error correction, a replacement audio data interval 49 may be substituted for the defective audio data interval 43, as indicated by a replacement arrow 47, to yield an error-concealed audio data stream portion 40'.

In the example provided, the replacement audio data interval 49 is a copy of the previous error-free audio data interval 41. Because the error-free audio data interval 41 included no transient signal, the replacement audio data interval 49 provides no replacement transient signal for the corrupted or missing short transient signal 45. If the short transient signal 45 comprises a drum beat, for example, the resulting audio stream portion 40' would be conspicuously missing a drumbeat, an effect which would probably be noticed by a user of the mobile phone 11.

Figure 3:
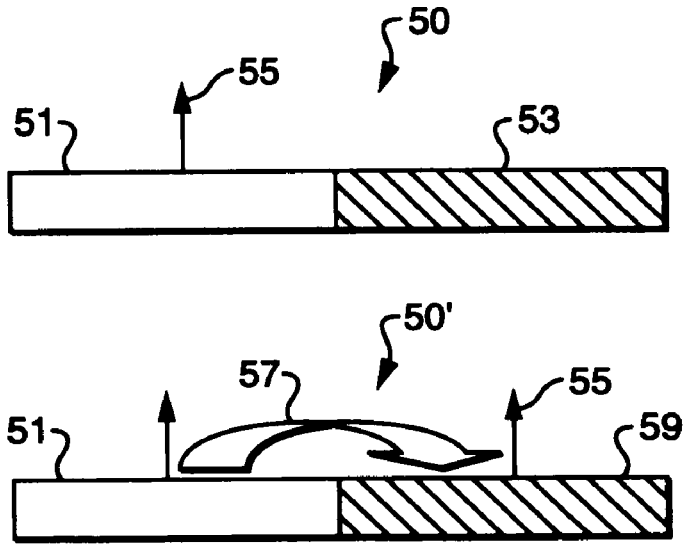
FIG. 3 (PRIOR ART)
FIG. 3 is an illustration of a double transient signal resulting from conventional error-concealment.

In another application, shown in FIG. 3, an audio stream portion 50 includes an error-free audio data interval 51 followed by a defective audio data interval 53 which originally did not include a short transient signal or drumbeat. In the conventional method of error correction, an error-concealed audio data stream portion 50' is produced by substituting a replacement audio data interval 59 for the defective audio data interval 53, as indicated by a replacement arrow 57. The replacement audio data interval 59 is a copy of the previous error-free audio data interval 51. However, because the error-free audio data interval 51 included a drumbeat 55, the replacement audio data interval 49 also includes the same drumbeat 55. This conventional error-correction thus produces a double-drumbeat, an effect which would probably be found objectionable by a user of the mobile phone 11. The error-concealment system and method disclosed herein overcomes conventional shortcomings, such as exemplified by the applications of FIGS. 2 and 3.

Figure 4:
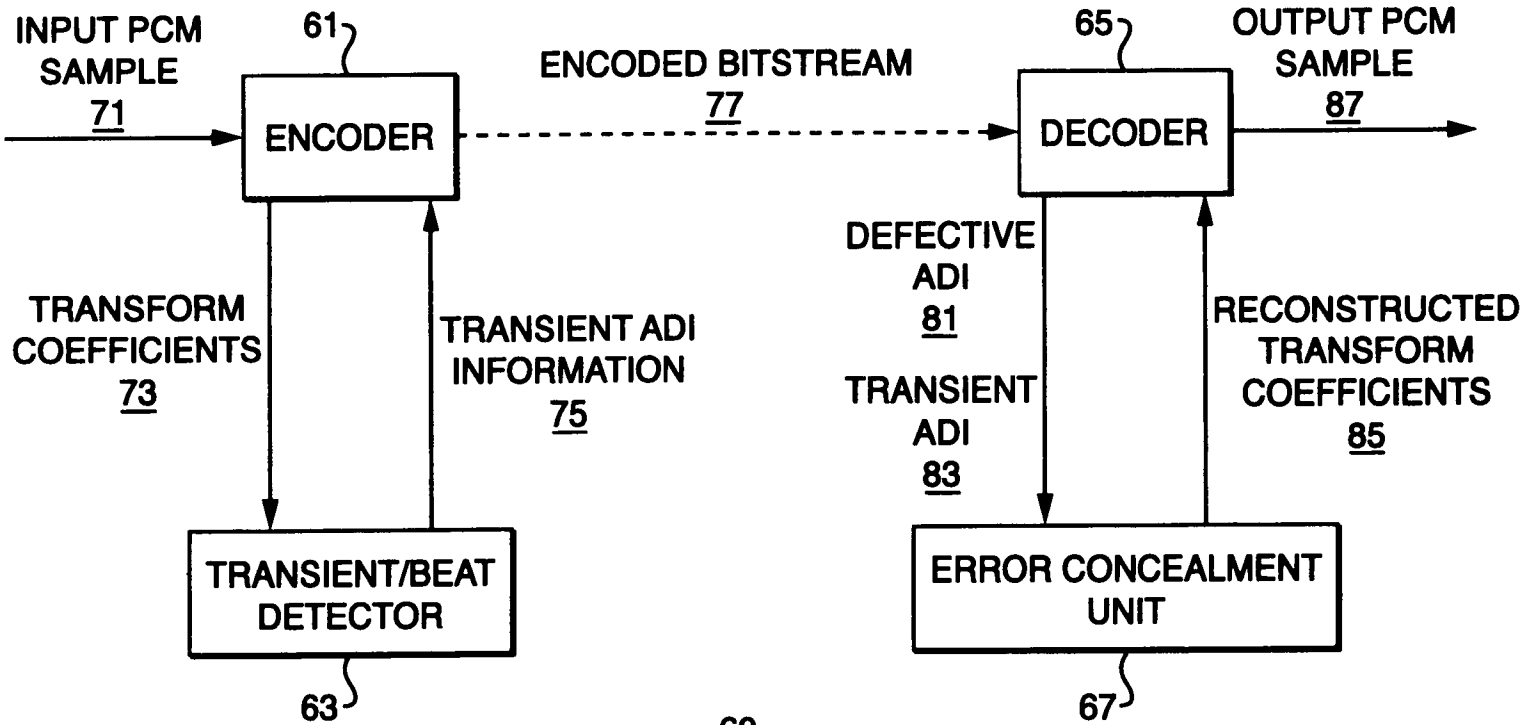
FIG. 4 is a general block diagram of a preferred embodiment of a digital audio error concealment system.
Figure 5:
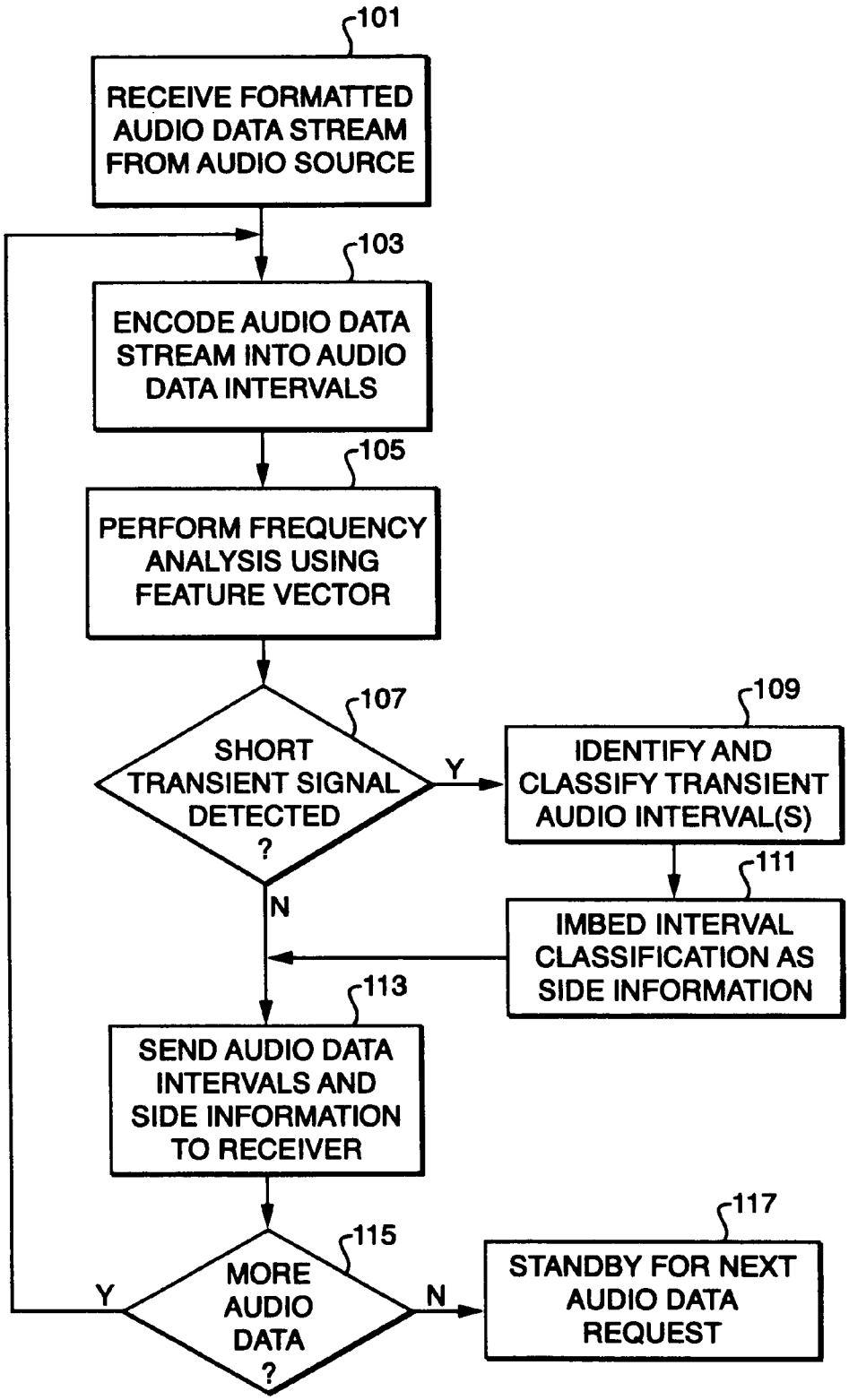
FIG. 5 is a flow diagram illustrating a transmission operation of the error concealment system of FIG. 4.

FIG. 4 presents a generalized block diagram of an error concealment system 60 for digital audio transmission. Operation of the error concealment system 60 can be explained with additional reference to the flow diagrams of FIGS. 5 and 6. The error concealment system 60 includes an encoder 61, which may be provided in the server unit 31, the PDA 39, or the source mobile phone 13 (FIG. 1). The error concealment system 60 also includes a decoder 65, which may be provided in the mobile phone 11, the PDA 27, or the computer 29 (FIG. 1). Audio data, such as a musical signal for example, is received at the encoder 61 and may be formatted as a PCM data sample 71, at step 101. The PCM data sample 71 is inputted to the encoder 61 for conversion into audio data intervals, at step 103. The encoder 61 may comprise an encoder based on an MPEG2/4 specification advanced audio encoding (AAC) codec to produce an encoded bitstream 77 such as an MPEG-2 AAC encoded bitstream comprising AAC frames having 1024 frequency components, for example.

The encoder 61 additionally performs a frequency analysis on the incoming musical signal 71, at step 105, yielding transform coefficients 73 which are used for transient or beat detection. The frequency analysis can use a modified discrete cosine transform (MDCT) to yield MDCT coefficients. In a preferred embodiment, a shifted discrete Fourier transform (SDFT) is used to produce SDFT coefficients. As can be appreciated by one skilled in the relevant art, SDFT is an orthogonal transform and produces more reliable results than MDCT which is not an orthogonal transform. See, for example, the technical paper by Wang, Y., Vilermo, M., and Isherwood, D. "*The Impact of the Relationship Between MDCT and DFT on Audio Compression: A Step Towards Solving the Mismatch*," ACM Multimedia 2000 International Conference, Oct. 30-Nov. 4, 2000. The transform coefficients are provided to a transient/beat detector 63 to determine if a current audio data interval includes a transient signal or drumbeat, at decision block 107.

Preferably, the transient/beat detection is performed using feature vectors (FV), which may take the form of a primitive band energy value, an element-to-mean ration (EMR) of the band energy, or a differential band energy value. The feature vector can be directly calculated from decoded MDCT coefficients, using the equation for the energy $E_b(n)$ of a band. The energy can be calculated directly by summing the squares of the MDCT coefficients to give:

$$E_b(n) = \sum_{j=N1}^{N2} [X_j(n)]^2 \tag{6}$$

where $X_j(n)$ is the $j^{th}$ normalized MDCT coefficient decoded at an audio data interval n, N1 is the lower bound index, and N2 is the higher bound index of MDCT coefficients defined in Tables I and II.

TABLE I

Subband division for long windows

| Sub-band | Frequency interval (Hz) | Index of MDCT coefficients | Scale factor band index |
|---|---|---|---|
| 1 | 0-459 | 0-11 | 0-2 |
| 2 | 460-918 | 12-23 | 3-5 |
| 3 | 919-1337 | 24-35 | 6-7 |
| 4 | 1338-3404 | 36-89 | 8-12 |
| 5 | 3405-7462 | 90-195 | 13-16 |
| 6 | 7463-22050 | 196-575 | 17-21 |

TABLE II

Subband division for short windows

| Sub-band | Frequency interval (Hz) | Index of MDCT coefficients | Scale factor band index |
|---|---|---|---|
| 1 | 0-459 | 0-3 | 0 |
| 2 | 460-918 | 4-7 | 1 |
| 3 | 919-1337 | 8-11 | 2 |
| 4 | 1338-3404 | 12-29 | 3-5 |
| 5 | 3405-7465 | 30-65 | 6-8 |
| 6 | 7463-22050 | 66-191 | 9-12 |

If no beat is detected, the current audio data interval can be classified as non-transient and operation proceeds to step 113. If a beat is detected, the current audio data is classified as a transient audio data interval, at step 109. The beat information obtained by the beat detector 63 is subsequently embedded within the encoded bitstream 77 as ancillary data or as side information, at step 111, and sent to the decoder 65, at step 113. If there is additional data forthcoming from the server unit 31, at decision block 115, operation returns to step 103. Otherwise, the encoder 61 of the error concealment system 60 stands by for the next audio data request from the mobile phone 11 or other user, at step 117.

Figure 6:
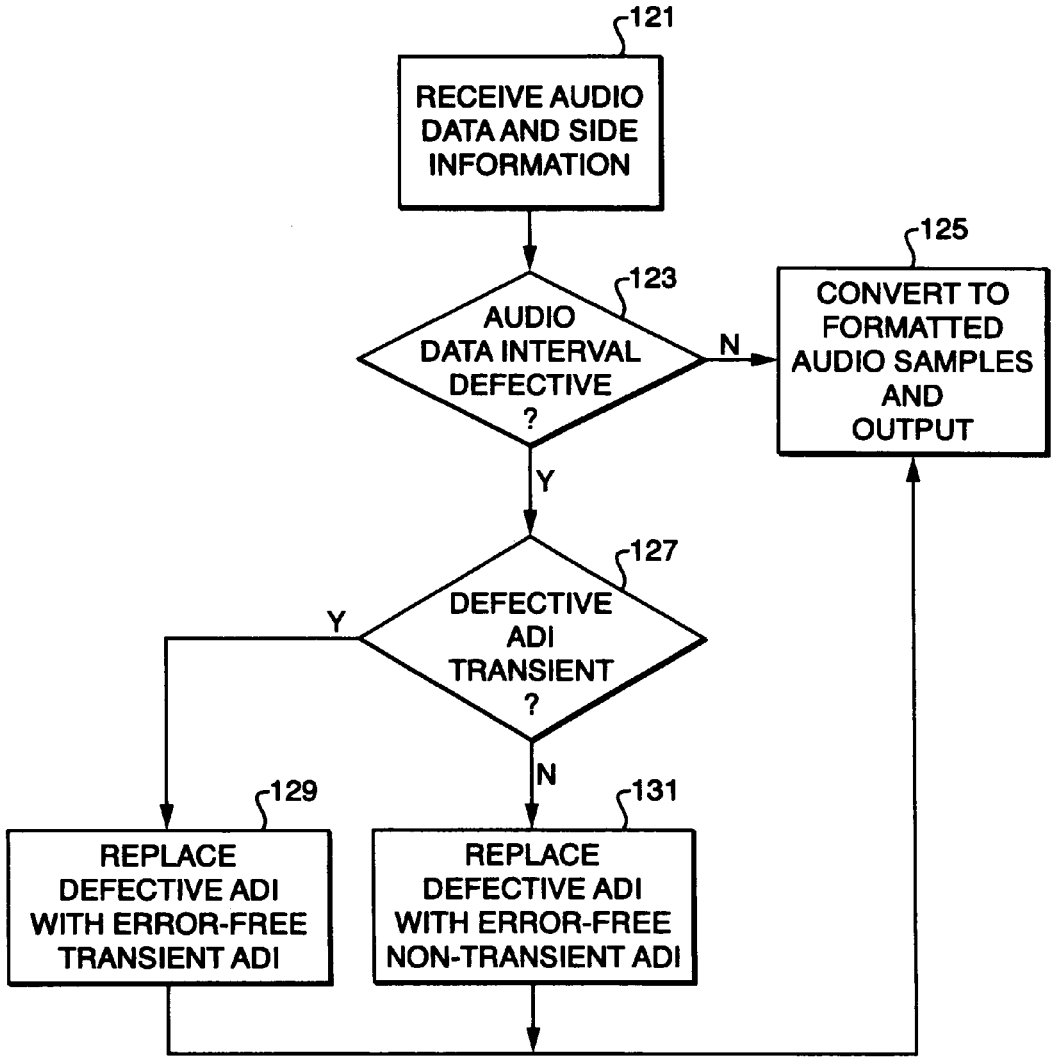
FIG. 6 is a flow diagram illustrating a receive operation of the error concealment system of FIG. 4.

The encoded bitstream 77 is received by a decoder 65, at step 121 in FIG. 6. If the decoder 65 detects no errors in the encoded bitstream 77, at step 123, the audio data intervals comprising the encoded bitstream 77 are converted to a formatted audio sample, such as PCM samples, at step 125. Otherwise, if the decoder 65 detects errors in the received encoded bitstream 77, the corresponding defective audio data interval 81 is provided to an error concealment unit 67. The defective audio data interval 81 is determined as either transient or non-transient, at decision block 127. Ancillary data embedded within the encoded bitstream 77 is used to identify a particular audio data interval as a transient audio data interval 83, as explained in greater detail below.

Accordingly, a transient defective audio data interval is replaced by an error-free transient audio data interval, at step 129, and converted for output from the decoder 65, at step 125. Likewise, a non-transient defective audio data interval is replaced by an error-free non-transient audio data interval, at step 131, and converted for output, at step 125. The error concealment unit 67 functions to conceal the detected errors, as described in greater detail below, by returning reconstructed transform coefficients 85, corresponding to the replacement audio data intervals, to the decoder 65 in place of erroneous or missing transform coefficients corresponding to the defective audio data intervals. The decoder 65 utilizes the reconstructed transform coefficients 85 to produce the error-concealed formatted output musical samples 87, at step 125.

Unlike audio transmission received at the encoder 61, there may be packet loss in the audio transmission transmitted to the decoder 65. This results in certain beats detected by the encoder 61 not reaching the decoder 65. Consequently, beat information obtained by the beat detector 63 at the encoder 61 is more reliable than beat information obtained at the decoder 65. It can thus be appreciated by one skilled in the relevant art that the disclosed error-concealment system and method, which detects beats or transients on the transmitter side, overcomes the limitations of conventional error-concealment systems and methods which perform beat detection on the receiver side.

Figure 7:
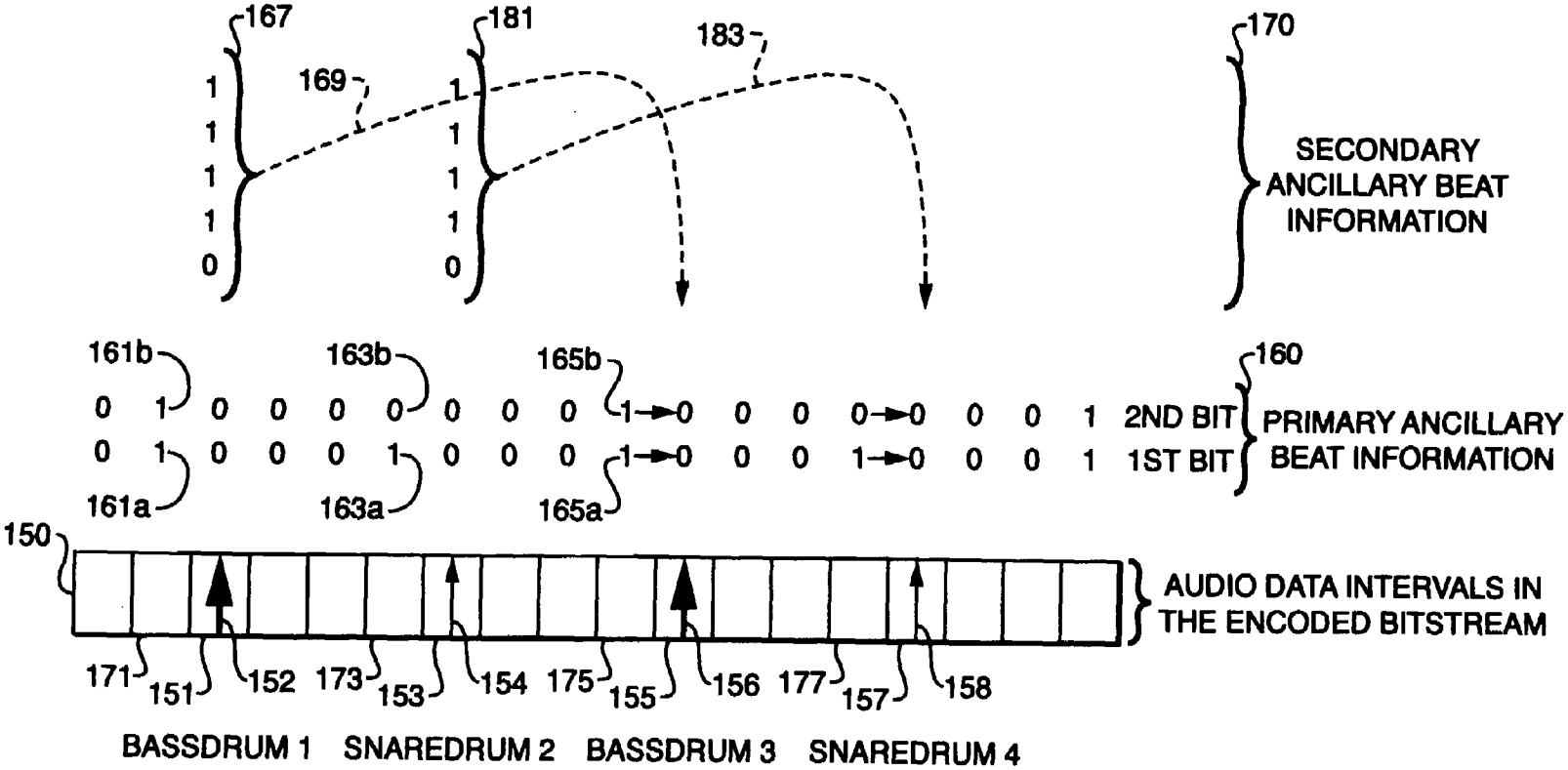
FIG. 7 is a diagram of an encoded bitstream including audio data intervals having short transient signals.

There is shown in FIG. 7 an encoded bitstream 150, such as can be transmitted from the encoder 61 to the decoder 65 (FIG. 4). The encoded bitstream 150 includes a transient audio data interval 151 which has a short transient signal 152 here denoted as 'Bassdrum1,' and a transient audio data interval 153 which has a short transient signal 154 here denoted as 'Snaredrum2.' The encoded bitstream 150 also includes a subsequent transient audio data interval 155 with a short transient signal 156 ('Bassdrum3') and a transient audio data interval 157 with a short transient signal 158 ('Snaredrum4'). The signal characteristics of the short transient signals 152 and 156 are similar to one another, and the signal characteristics of the short transient signals 154 and 158 are similar to one another. However, the signal characteristics of the short transient signals 152 and 156 are different from the signal characteristics of the short transient signals 154 and 158, such as in intensity and/or duration for example, and are accordingly labeled with a different descriptor.

In a preferred embodiment, the distinction between short transient signals is retained such that if the audio data interval 155 were found to be defective at the decoder 65, the error concealment unit 67 would provide audio data interval 151 as a replacement, as indicated by arrow 169, and not the audio data interval 153. Similarly, if the audio data interval 157 were defective, the audio data interval 153 would be a replacement, as indicated by arrow 183, and not the audio data interval 151. This distinction between two or more different types of transient signals, is provided by a primary set of ancillary beat information 160, or side information, received in the encoded bitstream 150. In the example shown, the ancillary beat information 160 comprises two data bits for each audio data interval in the encoded bitstream 150, including transient audio data intervals 151-157 and audio data intervals 171-177.

In the diagram, a first data bit 161*a* ancillary to the audio data interval 171 is used to indicate whether the subsequent audio data interval 151 includes a short transient signal, and a second data bit 161*b* is used to identify the type of short transient signal present in the subsequent audio data interval 151. The first data bit 161*a* has a value of '1' to indicate that the audio data interval 151 includes the short transient signal 152, and the second data bit 161*b* has a value of '1' to indicate that the short transient signal 152 is a 'bassdrum' beat. Similarly, a first data bit 163*a* ancillary to the audio data interval 173 has a value of '1' to indicate that the subsequent audio data interval 153 includes the short transient signal 154, and the second data bit 163*b* has a value of '0' to indicate that the short transient signal 154 is a 'snaredrum' beat.

Figure 8:
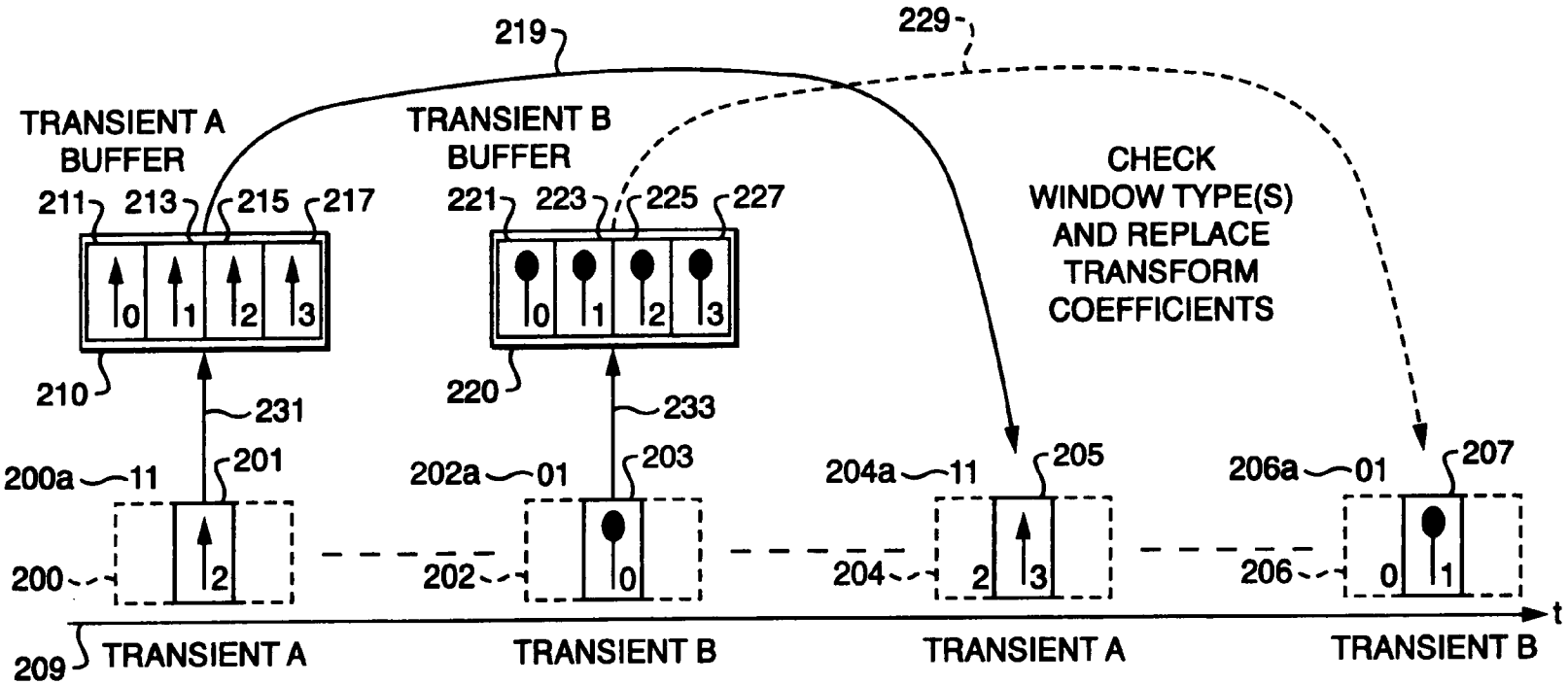
FIG. 8 is a diagram showing audio data interval updating and replacement via buffers using window type matching.

Thus, if the audio data interval 155 is found to be defective, the error concealment unit 67 reads a first data bit 165*a* and a second data bit 165*b* ancillary to the preceding audio data interval 175 to establish that a replacement audio data interval for the defective audio data interval 155 should include a 'bassdrum' short transient signal (i.e., the short transient signal 156). Accordingly, as indicated by the arrow 161, the error concealment unit 67 retrieves the audio data interval 151 from a buffer (such as shown in FIG. 8) as a replacement for the defective audio data interval 155. This method of replacing a defective audio data interval with an error-free audio data interval is referred to in the relevant art as a 'full-band' method of error-concealment.

Similarly, if the audio data interval 157 is found to be defective, the error concealment unit 67 reads the bits ancillary to the preceding audio data interval 177 to establish that a replacement audio data interval for the defective audio data interval 157 should include a 'snaredrum' short transient signal. The error concealment unit 67 retrieves the audio data interval 153. The error concealment unit 67 uses the replacement audio data interval 153 to reconstruct the transform coefficients 85 associated with the defective audio data interval 157, and sends the reconstructed transform coefficients 85 to the decoder 65 to produce the output musical samples 87.

It should be understood that that the present invention is not limited to just the one set of ancillary beat information 160 and that a secondary set of ancillary beat information 170 can be used to provide more information in an alternative embodiment and to provide for increased robustness against burst packet loss. In way of example, in the case where both the audio data interval 155 and the preceding audio data interval 175 are lost or corrupted, it is still possible to recover the position of the short transient signal 156 in the audio data interval 155 by obtaining the information provided in additional data bits 167 as indicated by arrow 169. Similarly, for loss of the audio data interval 157 and the preceding audio data interval 177, recovery is possible by the information provided in additional data bits 181 as indicated by arrow 183.

In an alternative preferred embodiment, shown in FIG. 8, there is provided in the error concealment unit 67 a first transient buffer 210 storing a plurality of transient audio data intervals 211-217 and a second transient buffer 220 storing a plurality of transient audio data intervals 221-227. Each of the transient audio data intervals 211-217 includes transfer coefficients, such as MDCT coefficients, for a first type of short transient signal or beat, each beat here denoted as a 'TransientA' type of beat (as represented by a triangular arrowhead), and each of the audio data intervals 221-227 includes transfer coefficients for a second type of short transient signal or beat, here denoted as a 'TransientB' type of beat (as represented by a round arrowhead). TransientA can represent a bassdrum beat, and TransientB can represent a snaredrum beat in accordance with the examples provided above.

As understood by one skilled in the relevant art, MP3 applications, for example, use four different window types for sampling: a long window, a long-to-short window (i.e., a 'stop' window), a short window, and a short-to-long window (i.e., a 'start' window). These window types are indexed as 0, 1, 2, and 3 respectively. Accordingly, each of the transient audio data intervals 211-217 comprises the same type of beat but a different window type. For example, the audio data interval 211 includes a TransientA type of beat in a type-0 window, the audio data interval 213 includes a TransientA type of beat in a type-1 window, and so on as indicated by the subscripts. Similarly, each of the audio data intervals 221-227 includes a TransientB type of beat with a different window type, as indicated by subscripts.

Figure 9:
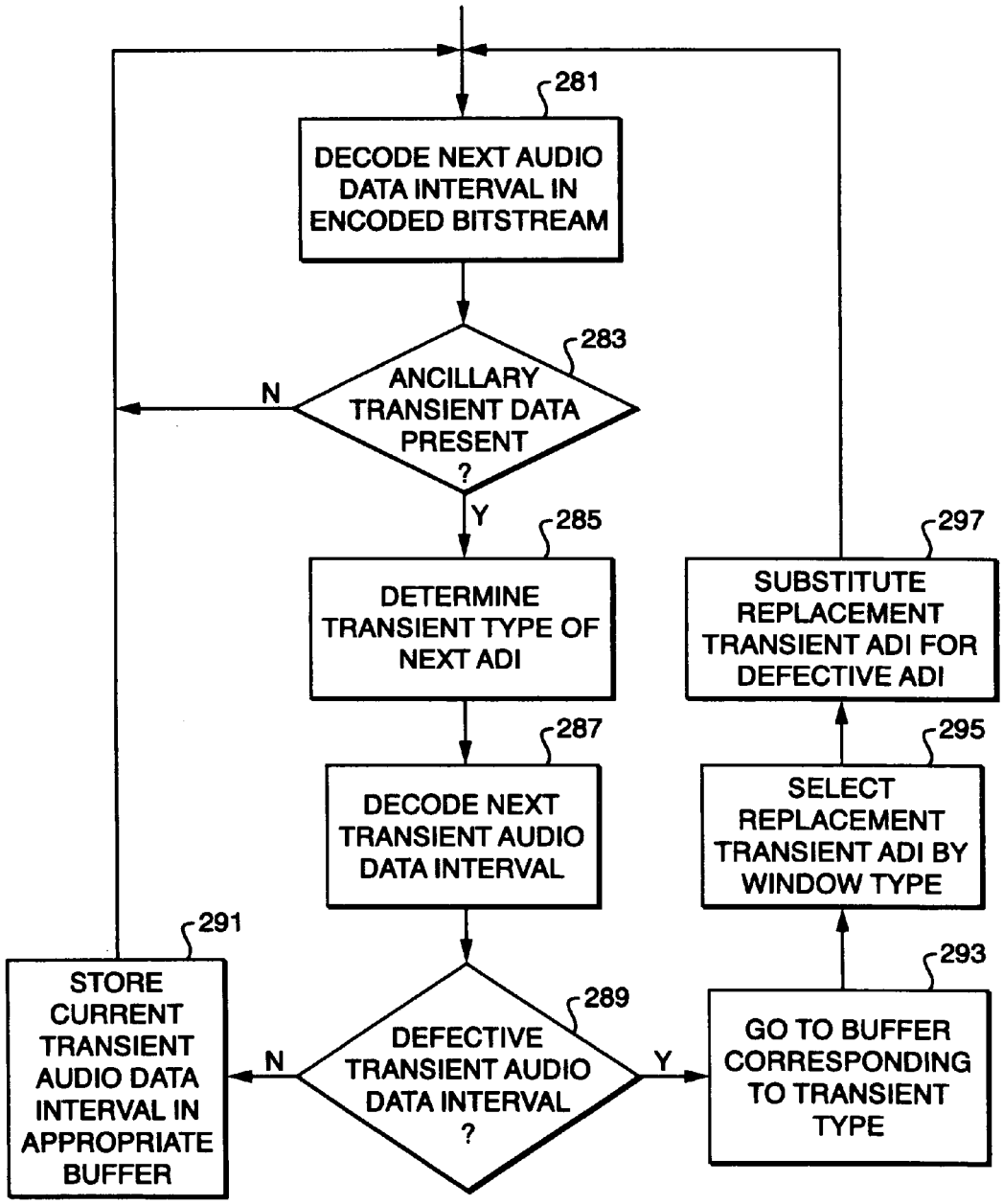
FIG. 9 is a flow diagram illustrating the operation of audio data interval updating and replacement in the diagram of FIG. 8.

The functions performed using the transient buffers 210 and 220 can be described with additional reference to the flow diagram of FIG. 9. The decoder 65 (FIG. 4) operates to decode audio data intervals received in the encoded bitstream 77, a portion of which is represented by a disjoint series of audio data intervals 200-207 on a time coordinate 209 in FIG. 8. The decoder 65 decodes the next audio data interval in the encoded bitstream 77, at step 281, represented here by an audio data interval 200. The decoder 65 checks the audio data interval 200 for ancillary data pertaining to beat information in the next audio data interval 201. If there is no ancillary data provided, operation returns to step 281. If, at decision block 283, ancillary transient data 200*a* is present, the bits '1' and '1' are used to determine that, if error-free, the next audio data interval 201 includes a TransientA beat, at step 285. The next audio data interval 201 is decoded, at step 287, and a query is made as to whether the audio data interval 201 is defective, at decision block 289.

If the audio data interval 201 is error-free, the TransientA buffer 210 is updated with the audio data interval 201, as indicated by arrow 231. In the example provided, the audio data interval 201 includes a beat in a type-2 window. Accordingly, transform coefficients in the buffered transient audio data interval 215 are replaced by the transform coefficients in the decoded audio data interval 201, at step 291, and operation returns to step 281. At some later time, the decoder 65 determines from an audio data interval 202 that the next audio data interval 203 should be a transient audio data interval with a TransientB-type beat. Accordingly, if the transient audio data interval 203 is error-free, the second transient buffer 220 is updated by replacing the buffered type-0 window transient audio data interval 221 with the decoded transient audio data interval 203, as indicated by arrow 233.

If, at decision block 289, a transient audio data interval is found to be defective, the decoder goes to a buffer corresponding to the transient type and to the window-type missing from the defective transient audio data interval, at step 293, and the correct transient audio data interval is retrieved from the correct transient buffer for replacement, at step 295. The retrieved transient audio data interval is substituted for the defective transient audio data interval, at step 297, and operation returns to step 281. In the example provided, an audio data interval 205 is found to be defective. From the preceding transient audio data interval 204, which is a type-2 window and which includes the bits '1' and '1' in the ancillary data, the decoder 65 determines that the defective transient audio data interval 205 originally included a TransientA-type beat in a type-3 window. This determination is made on the expected occurrence of a type-3 window following a type-2 window in the proximity of a transient. Accordingly, the defective transient audio data interval 205 is replaced by transient audio data interval 217 obtained from the first transient buffer 210. Likewise, for a defective transient audio data interval 207, information obtained from a preceding audio data interval 206 indicates that the original transient audio data interval 207 included a TransientB-type beat in a type-1 window. Accordingly, a transient audio data interval 223 is selected for replacement of the defective transient audio data interval 207.

Figure 10:
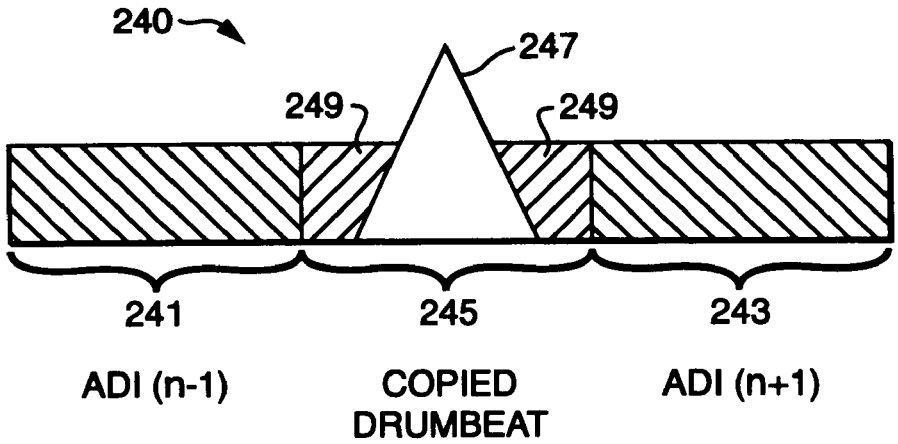
FIG. 10 is a diagram of a replacement transient audio data interval disposed between two error-free audio data intervals.

There is shown in FIG. 10, a diagrammatical illustration of an encoded bitstream segment 240 including an error-free $(n-1)^{th}$ audio data interval 241 and an error-free $(n+1)^{th}$ audio data interval 243. An $n^{th}$ audio data interval (not shown) originally transmitted between the $(n-1)^{th}$ audio data interval 241 and the $(n+1)^{th}$ audio data interval 243 was found to be defective and, accordingly, was replaced by a replacement audio data interval 245 comprising a drumbeat 247 and harmonic structure 249 adjacent the drumbeat 247. The harmonic structure 249 is provided by copying from a previous audio data interval (not shown) associated with the replacement drumbeat 247. Accordingly, there results a discontinuity in the harmonic structure from the audio data interval 241 to the harmonic structure 249, and from the harmonic structure 249 to audio data interval 243. This audio discontinuity has been referred to in the relevant art as a 'spectral fine structure disruption effect.'

Figure 11:
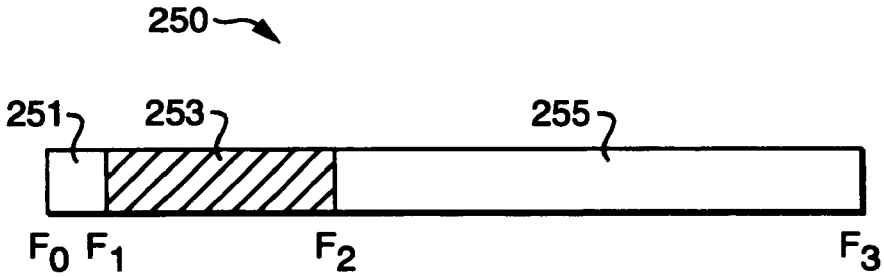
FIG. 11 is a diagram representing a frequency spectrum of a replacement audio data interval.

To mitigate this effect, a sub-band method of audio data interval replacement can be used in place of the full-band method described above. The sub-band method can be explained with reference to the diagram in FIG. 11 in which is shown an audio data interval frequency band 250 divided into a low-frequency band 251 (i.e., frequency range $F_0$ to $F_1$), a mid-frequency band 253 (i.e., frequency range $F_1$ to $F_2$), and a high-frequency band 255 (i.e., frequency range $F_2$ to $F_3$). The mid-frequency band 253 represents the most relevant harmonic and melodic parts of the audio data signal. The low-frequency band 251 and the high-frequency band 255 are more relevant for the drumbeat. In an alternative preferred embodiment, the low-frequency band 251 and the high-frequency band 255 are copied from a previous beat containing an appropriate drum beat (not shown), and the mid-frequency band 253 is copied from a neighboring audio data interval, for example from the audio data interval 241 (FIG. 10) for replacement as the harmonic structure 249. In one preferred embodiment, $F_1$ is approximately 344 Hz, and $F_2$ is about 4500 Hz. These values were obtained empirically based on the spectrogram observation of relevant test signals and the constraints of the AAC standard. In way of example, $F_1$ corresponds to the $16^{th}$ MDCT coefficient for a long type-0 window, and $F_2$ corresponds to the $208^{th}$ MDCT coefficient. For a short type-2 window, $F_1$ corresponds to the $2^{nd}$ MDCT coefficient, and $F_2$ corresponds to the $26^{th}$ MDCT coefficient.

Figure 12:
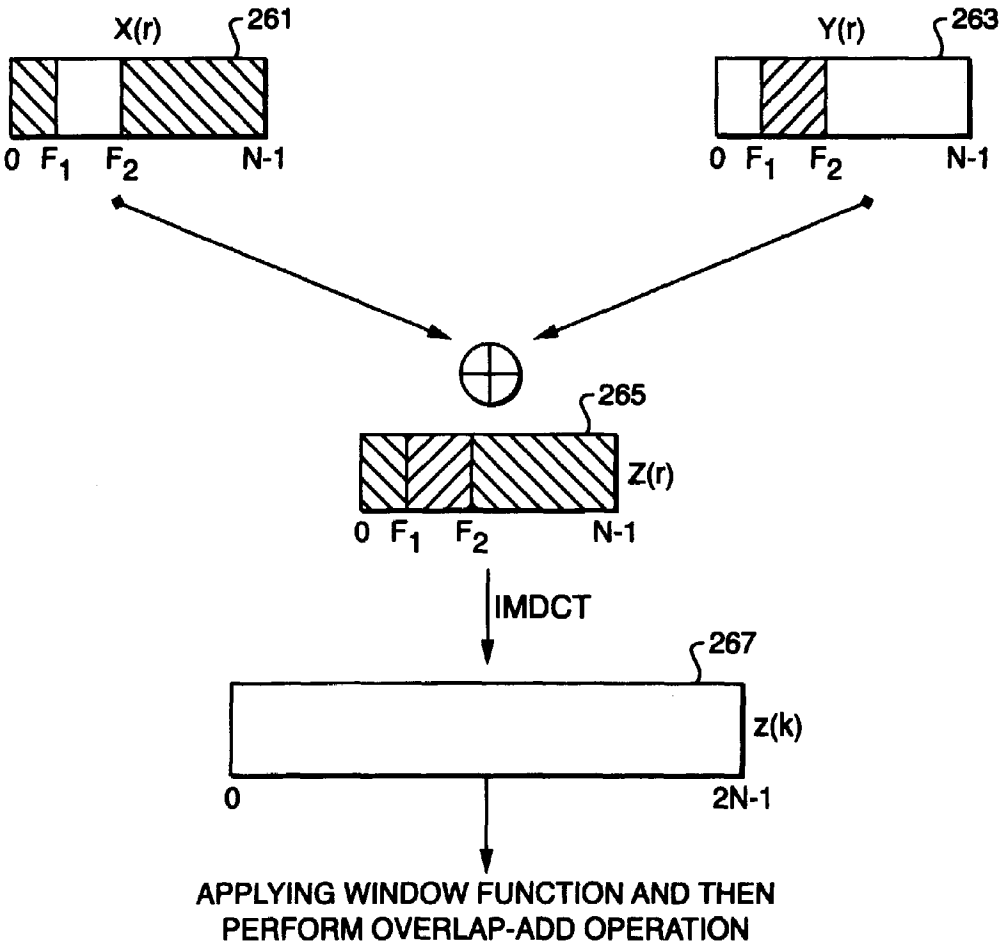
FIG. 12 is a diagram representing a composition operation to form a replacement audio data interval.

This method is shown in greater detail in FIG. 12 as a composition or mixing operation used to produce a replacement audio data interval 265. This composition method combines a first audio data interval 261, denoted by X(r), and a second audio data interval 263, denoted by Y(r) to produce a composite audio data interval, denoted by Z(r). The first audio data interval 261 comprises the spectral data from a previous beat or transient signal, such as may be obtained from a transient buffer. The second audio data interval 263 comprises an audio data interval (not shown) in a transfer domain preceding the defective audio data interval. The replacement transfer coefficients for the defective audio data interval are given by Z(r):

$$Z(r)=\alpha(r)X(r)+\beta(r)Y(r),\ 0\leqq r\leqq N-1 \tag{1}$$

where α(r) and β(r) are weighting functions across the entire frequency band with constraints of $$\alpha(r)+\beta(r)=1,\ 0\leqq r\leqq N-1 \tag{2}$$

and $$\alpha(r),\ \beta(r)\geqq 0,\ 0\leqq r\leqq N-1 \tag{3}$$

The parameters α(r)and β(r) can be adaptive to the actual signal, or can be static parameters for simplicity. The design principle is to maintain the harmonic continuity while keeping the beat structure in place. A simple implementation can be $$\alpha(r)=\begin{cases}0, & F_1<r\leq F_2\\ 1, & \text{elsewhere}\end{cases} \tag{4}$$

$$\beta(r)=\begin{cases}1, & F_1<r\leq F_2\\ 0, & \text{elsewhere}\end{cases} \tag{5}$$

where z(k) is an output audio signal 267 after application of an inverse transform, such as an inverse modified discrete cosine transform (IMDCT), of Z(r):

$$z(k)=IMDCT(Z(r)) \tag{6}$$

The audio data interval 265 formed by the function z(k) is used as a replacement for the defective audio data interval. This method has low computational complexity and low memory requirements in the decoder 65 and can be advantageously used in smaller devices such as the mobile phone 11.

Figure 13:
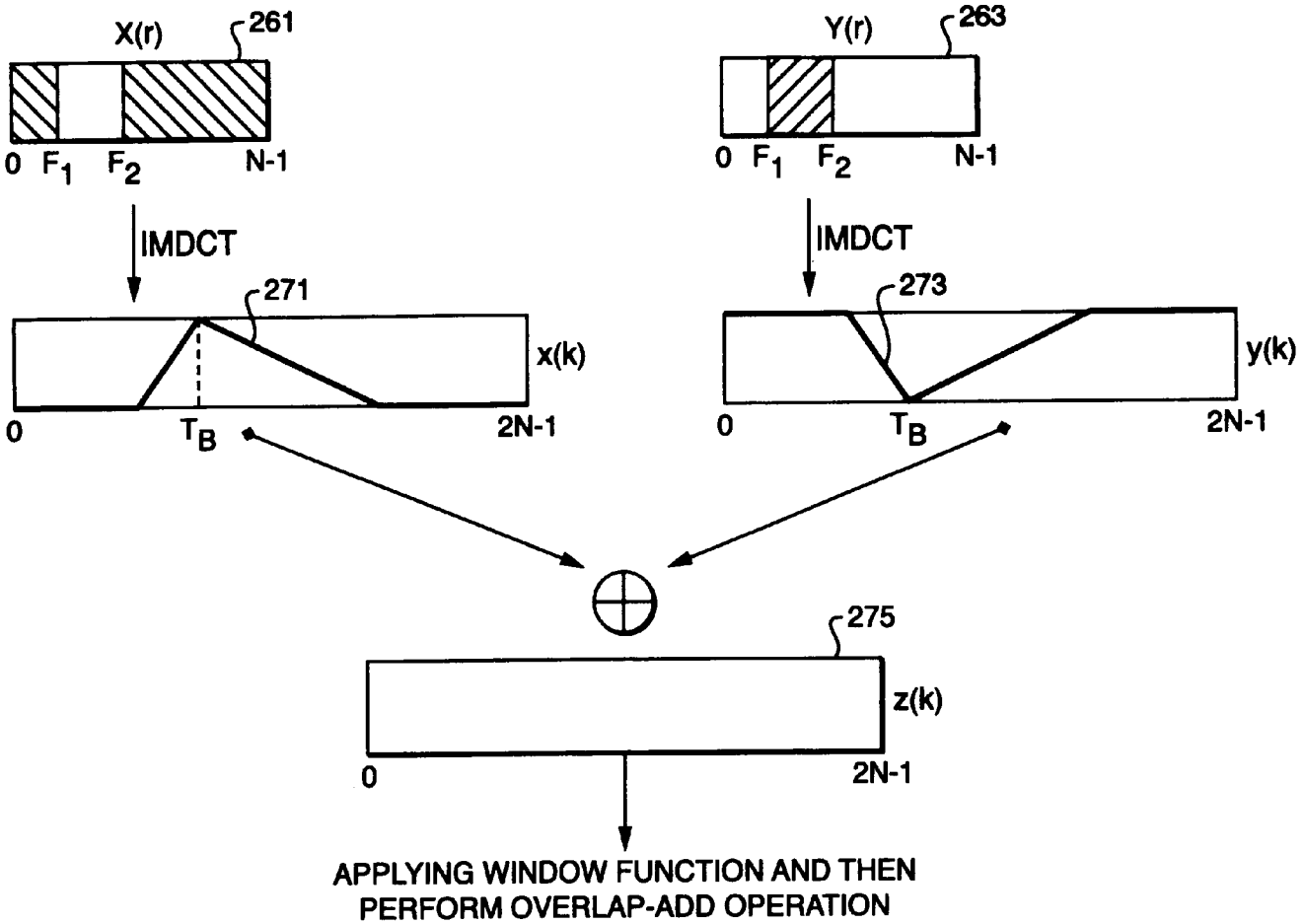
FIG. 13 is a diagram representing an alternative composition operation to form a replacement audio data interval.

For better performance, an alternative embodiment of the disclosed method is illustrated in FIG. 13. The two signals, x(k) and y(k), are first weighted in the frequency domain before inversely transforming back to time domain. For MDCT transform, $$x(k)=IMDCT[\alpha(r)X(r)] \tag{7}$$

$$y(k)=IMDCT[\beta(r)Y(r)] \tag{8}$$

where α(r) and β(r) are weighting functions in the frequency domain similar to the weighting functions in equation (1). The replacement signal 275(z(k)) is then constructed as $$z(k)=a(k)x(k)+b(k)y(k),\ 0\leqq k\leqq 2N-1 \tag{9}$$

where a(k) and b(k) are weighting functions in the time domain with constraints of $$a(k)+b(k)=1,\ 0\leqq k\leqq 2N-1 \tag{10}$$

$$a(k),b(k)\geqq 0,\ 0\leqq k\leqq 2N-1 \tag{11}$$

The parameters a(k) and b(k) can be adaptive to the actual signal or static. The design principle is to estimate the drum contour in time domain. For a simple implementation, a(k) can be a static function such as a triangle function 271 to approximate the drum contour in time domain. The asymmetric triangle 273 indicates that the onset of a drum is generally much shorter than the subsequent decay. The term $T_B$ indicates the maximum of the weighting function a(k).

The above is a description of the realization of the invention and its embodiments utilizing examples. It should be self-evident to a person skilled in the relevant art that the invention is not limited to the details of the above presented examples, and that the invention can also be realized in other embodiments without deviating from the characteristics of the invention. Thus, the possibilities to realize and use the invention are limited only by the claims, and by the equivalent embodiments which are included in the scope of the invention.

What is claimed is:

1. A method comprising:

(a) formatting a stream of audio data provided by a audio source into a sequence of audio data intervals;

(b) transform encoding the sequence of audio data intervals to form a sequence of encoded audio data intervals, each of the encoded audio data intervals having a plurality of transform coefficients;

(c) analyzing the transform coefficients of the sequence of encoded audio data intervals in the sequence so as to identify encoded transient audio data intervals, each of the encoded transient audio data intervals including a short transient signal having first transient signal characteristics; and (d) embedding ancillary data into encoded audio data intervals preceding the encoded transient audio data intervals, the ancillary data providing notification that the encoded transient audio data intervals include the short transient signals.

2. A method as in claim 1 wherein the audio data intervals are formatted as pulse code modulation data.

3. A method as in claim 1 wherein step (b) comprises applying a modified discrete cosine transform to the sequence of audio data intervals.

4. A method as in claim 1 wherein step (b) comprises applying a shifted discrete Fourier transform to the sequence of audio data intervals.

5. A method as in claim 1 further comprising the steps of:

sending the encoded audio data intervals having the ancillary information to a receiver; and subsequently sending the encoded transient audio data intervals to the receiver.

6. A method as in claim 1 wherein the short transient signal comprises a drumbeat.

7. A method as in claim 1 further comprising the steps of:

(e) analyzing the sequence of encoded audio data intervals to identify encoded transient audio data intervals which include a short transient signal having second transient signal characteristics; and (f) embedding a second type of ancillary data into encoded audio data intervals of the sequence that precede the encoded transient audio data intervals including the short transient signal having second transient signal characteristics, the second type of ancillary data providing notification of the encoded transient audio data intervals including the short transient signal having second transient signal characteristics.

8. A method as in claim 1 wherein each of the encoded audio data intervals has a plurality of frequency domain transform coefficients, and step (c) comprises analyzing the frequency domain transform coefficients of the sequence of encoded audio data intervals to identify encoded transient audio data intervals.

9. A method as in claim 1 wherein the ancillary data in each of the preceding encoded audio data intervals is distinct from data identifying a sampling window applicable to the encoded audio data transient interval for which that ancillary data provides notification.

10. A method as in claim 1 wherein step (c) comprises, as to each of the encoded audio data intervals in the sequence, performing a frequency analysis on the transform coefficients to detect the short transient signal.

11. A method as in claim 10 wherein performing a frequency analysis comprises applying a shifted discrete Fourier transform.

12. A method as in claim 10 wherein performing a frequency analysis comprises extracting a feature vector from the transform coefficients.

13. A method as in claim 12 wherein the feature vector comprises a member of a group consisting of a primitive band energy value, an element-to-mean ratio of band energy, and a differential band energy value.

14. A method comprising:

(a) receiving transform-encoded audio data intervals of a sequence of transform-encoded audio data intervals, each of the intervals having a plurality of transform coefficients, wherein less than all of the intervals are transient intervals, and wherein each of the transient intervals corresponds to an audio segment that includes a beat;

(b) receiving ancillary data identifying the transient intervals;

(c) identifying transient intervals of the sequence that are defective; and (d) replacing transform coefficients of the defective transient intervals with transform coefficients from received transient intervals not identified as defective.

15. A method as in claim 14 wherein step (c) comprises determining whether a transient interval of the sequence is corrupted or missing.

16. A method as in claim 14 wherein step (d) comprises, as to each of the defective transient intervals, replacing the transform coefficients of the defective transient interval with transform coefficients from a previously-received transient interval.

17. A method as in claim 14 wherein step (d) comprises, as to each of the defective transient intervals, (d1) matching a window type of the defective transient interval with a window type of a received transient interval not identified as defective, and (d2) replacing transform coefficients of the defective transient interval with transform coefficients from the matching received non-defective transient interval.

18. A method as in claim 14, further comprising the step of:

(e) identifying each of multiple transient intervals received in step (a) by a type of beat in the audio segment to which that transient interval corresponds, and wherein step (d) comprises, as to each of the defective transient intervals, (d1) matching the beat type of the defective transient interval with the beat type of a non-defective received transient interval, and (d2) replacing transform coefficients of the defective transient interval with transform coefficients from the matching non-defective received transient interval.

19. A method as in claim 14, further comprising the step of:

(e) identifying each of multiple transient intervals received in step (a) by a type of beat in the audio segment to which that transient interval corresponds, and wherein step (d) comprises, as to each of the defective transient intervals, (d1) matching a window type and the beat type of the defective transient interval with a window type and the beat type of a non-defective received transient interval, (d2) replacing transform coefficients of the defective transient interval with transform coefficients from the matching non-defective received transient interval.

20. A method as in claim 14 further comprising the step of:

(e) converting received intervals not identified as defective and the intervals having replacement coefficients to formatted audio samples.

21. A method as in claim 20 wherein the formatted audio samples are pulse code modulation formatted.

22. A method as in claim 14 wherein step (d) comprises, as to each of the defective transient intervals, (d1) replacing transform coefficients for a low-frequency band and for a high-frequency band with transform coefficients from a received transient interval not identified as defective, and (d2) replacing transform coefficients for a mid-frequency band with transform coefficients from a received interval other than the interval supplying the replacement coefficients in step (d1).

23. A method as in claim 22, further comprising the steps of:

(e) as to each of the defective transient intervals, (e1) inversely transforming the mid-frequency band replaced coefficients to a time domain component, (e2) inversely transforming the low-frequency and high-frequency band replaced coefficients to a time domain component, and (e3) constructing a replacement signal in the time domain corresponding to the defective transient interval by weighting and combining the time domain components of steps (e1) and (e2).

24. A method as in claim 23, wherein step (e3) comprises weighting the time domain components of steps (e1) and (e2) using triangle functions.

25. A device comprising:

a decoder configured to perform steps that include (a) receiving transform-encoded audio data intervals of a sequence of transform-encoded audio data intervals, each of the intervals having a plurality of transform coefficients, wherein less than all of the intervals are transient intervals, and wherein each of the transient intervals corresponds to an audio segment that includes a beat, (b) retrieving ancillary data identifying the transient intervals, and (c) identifying transient intervals of the sequence that are defective; and an error concealment unit configured to perform a step that includes (d) providing replacement transform coefficients for defective transient intervals, wherein the replacement transform coefficients are obtained from received transient intervals not identified as defective, and wherein the decoder is further configured to perform steps that include (e) as to each of the defective transient intervals, (e1) matching a window type of the defective transient interval with a window type of a received transient interval not identified as defective, and (e2) replacing transform coefficients of the defective transient interval with transform coefficients from the matching non-defective received transient interval.

26. A device as in claim 25 further comprising a buffer for storing at least one received transient interval not identified as defective.

27. A device as in claim 26 wherein step (d) comprises, as to each of the defective transient intervals, providing replacement transform coefficients obtained from a previously-received transient interval.

28. A system comprising:

an audio source for providing audio streaming information, the audio source including an encoder for converting the audio streaming information into a sequence of coded audio data intervals, each of the coded audio data intervals having a plurality of frequency domain transform coefficients, and a transient detector for classifying, by analysis of frequency domain transform coefficients, coded audio data intervals of the sequence that have a short transient signal as transient coded audio data intervals; and a receiving terminal for converting the sequence of coded audio data intervals into the audio sample, the receiving terminal including an error concealment unit for replacing frequency domain transform coefficients of a defective transient audio data interval with frequency domain transform coefficients from a received transient audio data interval found to be error-free.

29. An error concealment system as in claim 28 wherein the receiving terminal further comprises a decoder for decoding the sequence of coded audio data intervals.

30. An error concealment system as in claim 28 wherein the audio source comprises a member of the group consisting of a server unit, a microphone, a personal digital assistant, and a mobile phone.

31. An error concealment system as in claim 28 wherein the receiving terminal comprises a member of the group consisting of a mobile phone, a personal digital assistant, and a computer.

32. An error concealment system as in claim 28 further comprising a telecommunications network connecting the receiving terminal with the audio source.

33. An error concealment system as in claim 32 wherein the telecommunications network comprises a wired network suitable for access by a telephone.

34. An error concealment system as in claim 32 wherein the telecommunications network comprises a member of the group consisting of a Global System for Mobile Communications (GSM), a General Packet Radio Service (GPRS), a Wideband CDMA (WCDMA), a DECT, a wireless LAN (WLAN), and a Universal Mobile Telecommunications System (UMIS).

35. A device comprising:

a decoder configured to perform steps that include (a) receiving transform-encoded audio data intervals of a sequence of transform-encoded audio data intervals, each of the intervals having a plurality of transform coefficients, wherein less than all of the intervals are transient intervals, and wherein each of the transient intervals corresponds to an audio segment that includes a beat, (b) retrieving ancillary data identifying the transient intervals, and (c) identifying transient intervals of the sequence that are defective; and an error concealment unit configured to perform a step that includes (d) providing replacement transform coefficients for defective transient intervals, wherein the replacement transform coefficients are obtained from received transient intervals not identified as defective, and wherein the decoder is further configured to perform steps that include (e) identifying each of multiple transient intervals received in step (a) by a type of beat in the audio segment to which that transient interval corresponds, and (f) as to each of the defective transient intervals, (f1) matching the beat type of the defective transient interval with the beat type of a non-defective received transient interval, and (f3) replacing transform coefficients of the defective transient interval with transform coefficients from the matching non-defective received transient interval.

36. A device comprising:

a decoder configured to perform steps that include (a) receiving transform-encoded audio data intervals of a sequence of transform-encoded audio data intervals, each of the intervals having a plurality of transform coefficients, wherein less than all of the intervals are transient intervals, and wherein each of the transient intervals corresponds to an audio segment that includes a beat, (b) retrieving ancillary data identifying the transient intervals, and (c) identifying transient intervals of the sequence that are defective; and an error concealment unit configured to perform a step that includes (d) providing replacement transform coefficients for defective transient intervals, wherein the replacement transform coefficients are obtained from received transient intervals not identified as defective, and wherein the decoder is further configured to perform steps that include (e) identifying each of multiple transient intervals received in step (a) by a type of beat in the audio segment to which that transient interval corresponds, and (f) as to each of the defective transient intervals, (f1) matching a window type and the beat type of the defective transient interval with a window type and the beat type of a non-defective received transient interval, (f2) replacing transform coefficients of the defective transient interval with transform coefficients from the matching non-defective received transient interval.

37. A device comprising:

a decoder configured to perform steps that include (a) receiving transform-encoded audio data intervals of a sequence of transform-encoded audio data intervals, each of the intervals having a plurality of transform coefficients, wherein less than all of the intervals are transient intervals, and wherein each of the transient intervals corresponds to an audio segment that includes a beat, (b) retrieving ancillary data identifying the transient intervals, and (c) identifying transient intervals of the sequence that are defective; and an error concealment unit configured to perform a step that includes (d) providing replacement transform coefficients for defective transient intervals, wherein the replacement transform coefficients are obtained from received transient intervals not identified as defective, and wherein the decoder is further configured to perform steps that include (e) as to each of the defective transient intervals, (e1) replacing transform coefficients for a low-frequency band and for a high-frequency band with transform coefficients from a received transient interval not identified as defective, and (e2) replacing transform coefficients for a mid-frequency band with transform coefficients from a received interval other than the interval supplying the replacement coefficients in step (e1).

38. A device as in claim 37 wherein the decoder is further configured to perform steps that include (e) as to each of the defective transient intervals, (e3) inversely transforming the mid-frequency band replaced coefficients to a time domain component, (e4) inversely transforming the low-frequency and high-frequency band replaced coefficients to a time domain component, and (e5) constructing a replacement signal in the time domain corresponding to the defective transient interval by weighting and combining the time domain components of steps (e3) and (e4).

39. A device as in claim 38, wherein step (e5) comprises weighting the time domain components of steps (e3) and (e4) using triangle functions.

* * * * *